US006606872B1

(12) United States Patent
Smith

(10) Patent No.: US 6,606,872 B1
(45) Date of Patent: Aug. 19, 2003

(54) ACTIVE REFRIGERANT CIRCUIT USING CONDENSER FAN OF AN INACTIVE CIRCUIT

(75) Inventor: Sean A Smith, La Crosse, WI (US)

(73) Assignee: American Standard International Inc., New York, NY (US)

( * ) Notice: Subject to any disclaimer, the term of this patent is extended or adjusted under 35 U.S.C. 154(b) by 0 days.

(21) Appl. No.: 10/153,192

(22) Filed: May 20, 2002

(51) Int. Cl.[7] ..... F25B 39/04; F25B 7/00
(52) U.S. Cl. ..... 62/175; 62/183
(58) Field of Search ..... 62/175, 179, 183, 62/180, 181, 335

(56) References Cited

U.S. PATENT DOCUMENTS 4,506,516 A 3/1985 Lord
4,628,701 A 12/1986 Phillips et al.
5,040,377 A * 8/1991 Braun et al. ..... 62/183
5,067,560 A 11/1991 Carey et al.
5,138,844 A 8/1992 Clanin et al.
5,687,579 A * 11/1997 Vaynberg ..... 62/175

* cited by examiner

*Primary Examiner*—Marc Norman
(74) *Attorney, Agent, or Firm*—William J. Beres; William O'Driscoll

(57) ABSTRACT

A chiller system includes at least two refrigerant circuits. In a low ambient temperature condition, only one refrigerant circuit is activated, but its condenser fan is de-energized. To provide some airflow across the condenser of the activated circuit, a condenser fan of the inactive circuit is energized. A small air duct allows the condenser fan of the inactive circuit to draw a low volume of air across the condenser of the active circuit.

24 Claims, 2 Drawing Sheets

ACTIVE REFRIGERANT CIRCUIT USING CONDENSER FAN OF AN INACTIVE CIRCUIT

BACKGROUND OF THE INVENTION

1. Field of the Invention

The present invention relates to air-cooled chillers. More particularly, the present invention relates to a chiller with multiple refrigerant circuits, wherein an active circuit uses airflow created by a condenser fan of an inactive circuit.

2. Description of Related Art

Chiller systems usually include at least one refrigerant circuit for providing a cooling effect. A typical refrigerant circuit comprises a compressor for compressing and forcing refrigerant through the circuit, a condenser for condensing compressed refrigerant and expelling waste heat, an expansion device for reducing the temperature of the refrigerant through expansion, and an evaporator that enables the refrigerant inside to cool an external fluid, such as air or water.

Some chiller systems include multiple refrigerant circuits that can be selectively activated for meeting a range of cooling demands. For high cooling demands, all of the circuits may be activated. Under certain low load conditions, some circuits, or selected components thereof, may be de-energized.

For instance, a chiller may include two refrigerant circuits, each having their own compressor, condenser, expansion device and evaporator: similar to the chiller disclosed in U.S. Pat. No. 4,506,516. At times, both circuits may work together to provide a maximum combined cooling effect. At moderate cooling loads, only one of the circuits may need to operate. If the load becomes even lighter, the capacity of the one circuit that is operating may itself need to be reduced. To reduce the capacity of a single refrigerant circuit, its condenser may be provided with several fans that can be individually de-energized to incrementally reduce the airflow across the condenser, as disclosed in U.S. Pat. Nos. 5,138,844 and 5,067,560.

However, under certain low ambient temperature conditions, even a single fan may provide too much airflow across the condenser. This may require the fan to cycle on and off excessively, which in turn can adversely affect load control, expansion valve positioning, and the quality of vapor entering the compressor. To avoid such problems, the last operating fan can be made smaller than the rest (e.g., U.S. Pat. No. 4,628,701), or the last operating fan can be driven by an inverter that reduces the speed of the fan. Unfortunately, inverters can be expensive, and a smaller fan can limit a chiller's maximum capacity. Moreover, even a smaller fan may provide too much airflow under certain conditions.

SUMMARY OF THE INVENTION

It is an object of the present invention to provide a simple, low-cost alternative to operating a multi-circuit chiller at low ambient temperature conditions.

Another object of the invention is to use a fan of an inactive condenser to cool a condenser of an active refrigerant circuit.

Another object pertaining to using a fan of an inactive condenser to cool an active condenser is to force appreciably less air across the active condenser than across the inactive condenser.

A still further object is to use an air duct to provide a restricted airflow path from one condenser of an active refrigerant circuit to another condenser of an inactive circuit.

One or more of these objects are provided by a chiller system that includes at least two refrigerant circuits. In a low ambient temperature condition, one circuit is active while the other is inactive. A condenser fan associated with the inactive circuit is energized to draw air across a condenser of the active circuit.

The present invention provides a chiller system. The chiller system comprises a first refrigerant circuit that includes an energized compressor and a first condenser; a second refrigerant circuit that includes a de-energized compressor and a second condenser; a de-energized fan adjacent the first condenser such that the de-energized fan is closer to the first condenser than the second condenser; and an energized fan adjacent the second condenser such that the energized fan is closer to the second condenser than the first condenser.

The present invention also provides a chiller system selectively operable in a low ambient temperature mode. The chiller comprises a first refrigerant circuit that includes a first compressor and a first condenser; a second refrigerant circuit that includes a second compressor and a second condenser; a first fan adjacent the first condenser such that the first fan is closer to the first condenser than the second condenser; a second fan adjacent the second condenser such that the second fan is closer to the second condenser than the first condenser; an air duct that places the first condenser in air communication with the second condenser; and a control operatively connected to the first compressor, the second compressor, the first fan and the second fan. The control energizes the first compressor, energizes the second fan, de-energizes the second compressor, and de-energizes the first fan to allow the second fan to draw air in series across the first condenser, through the air duct, and across the second condenser, thereby placing the chiller system in the low ambient temperature mode of operation.

The present invention further provides a chiller system. The chiller system comprises a first chiller module comprising a first refrigerant circuit and a first pair of condenser fans, and a second chiller module comprising a second refrigerant circuit and a second pair of condenser fans. The first refrigerant circuit includes, in series flow relationship with each other, a first compressor, a first condenser, a first expansion device, and a first evaporator. The first condenser defines a first condenser plenum, the first pair of condenser fans are adjacent the first condenser, and the first refrigerant circuit contains a first charge of refrigerant. The second refrigerant circuit includes, in series flow relationship with each other, a second compressor, a second condenser, a second expansion device, and a second evaporator. The second condenser defines a second condenser plenum, the second pair of condenser fans are adjacent the second condenser, and the second refrigerant circuit contains a second charge of refrigerant separate from the first charge of refrigerant. The chiller system also comprises an air duct connecting the first condenser plenum in fluid communication with the second condenser plenum; and a control operatively connected to the first compressor, the first pair of condenser fans, the second compressor, and the second pair of condenser fans. The control energizes the first compressor, energizes one fan of the second pair of condenser fans, de-energizes another fan of the second pair of condenser fans, and de-energizes the first pair of condenser fans, thereby placing the chiller system in a low ambient temperature mode of operation wherein the one fan draws air in series across the first condenser, through the first condenser plenum, through the air duct, through the second condenser plenum, and across the second condenser.

The present invention additionally provides a method of operating a chiller system. The method comprises forcing a first charge of refrigerant to flow in series through a first compressor and a first condenser; inhibiting a second charge of refrigerant from flowing in series through a second compressor and a second condenser; and forcing more air across the second condenser than across the first condenser.

The present invention moreover provides a chiller system. The system comprises a first compressor; a second compressor; a first condenser in operative association with the first compressor; a second condenser in operative association with the second compressor; elements forcing a first charge of refrigerant to flow in series through a first compressor and a first condenser; a device inhibiting a second charge of refrigerant from flowing in series through a second compressor and a second condenser; and a device forcing more air across the second condenser than across the first condenser.

DESCRIPTION OF THE DRAWING FIGURES

DESCRIPTION OF THE PREFERRED EMBODIMENT

Figure 1:
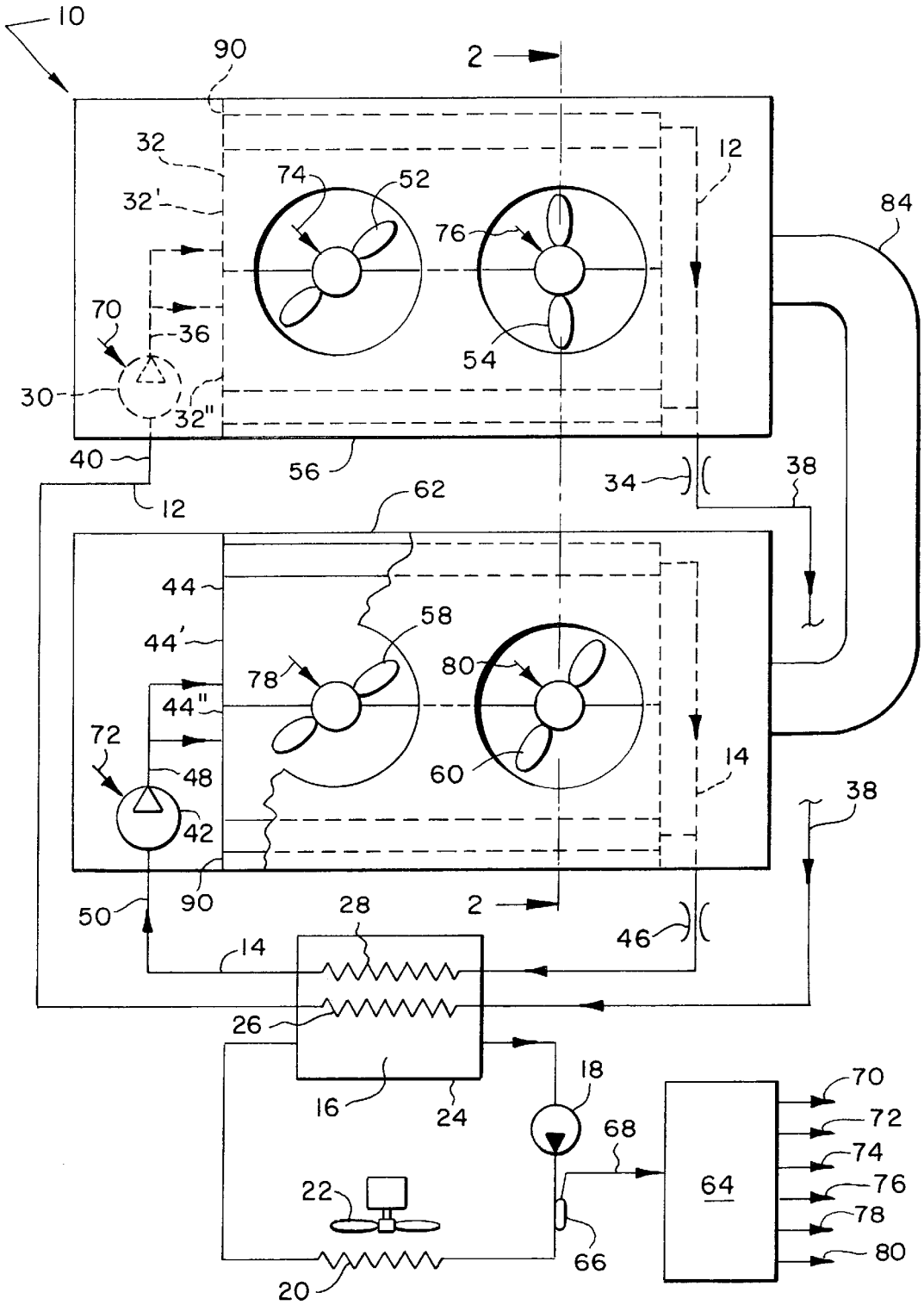
FIG. 1 is a generally schematic view of a chiller system according to one embodiment of the invention.

Referring to FIG. 1, a chiller system 10 includes at least two refrigerant circuits 12 and 14 for cooling an area within a building or to meet some other cooling demand. Multiple refrigerant circuits, as opposed to just one, provide chiller system 10 with multiple stages of cooling to meet a range of cooling demands. In some cases, refrigerant circuits 12 and 14 cool water 16 that a pump 18 conveys to one or more heat exchangers 20. A fan 22 can then force air across heat exchanger 20 to cool the desired area.

To cool the water, pump 18 can circulate the water through an evaporator shell 24 that contains two evaporators 26 and 28. Evaporator 26 is part of refrigerant circuit 12, and evaporator 28 is part of circuit 14. The actual structure of evaporator shell 24, and evaporators 26 and 28 may be of a conventional shell and tube design or be of some other structure well known to those skilled in the art.

Refrigerant circuit 12 comprises a compressor 30 for compressing and forcing a first charge of refrigerant through circuit 12, a condenser 32 for condensing compressed refrigerant and expelling waste heat, an expansion device 34 (e.g., expansion valve, orifice, capillary, etc.) for reducing the temperature of the refrigerant through expansion, and evaporator 26 that enables the refrigerant inside to cool water 16. Compressor 30 discharges the first charge of refrigerant through a discharge line 36. From line 36, the refrigerant travels sequentially through condenser 32, expansion device 34, a refrigerant line 38, evaporator 26, and back to a suction line 40 of compressor 30.

Likewise, refrigerant circuit 14 comprises a compressor 42 for compressing and forcing a second charge of refrigerant (isolated from the first charge of refrigerant) through circuit 14, a condenser 44 for condensing compressed refrigerant and expelling waste heat, an expansion device 46 for reducing the temperature of the refrigerant through expansion, and evaporator 28 that enables the refrigerant inside to cool water 16. Compressor 42 discharges the second charge of refrigerant through a discharge line 48. From line 48, the refrigerant travels sequentially through condenser 44, expansion device 46, evaporator 28, and back to a suction line 50 of compressor 42.

To enhance the condensers' ability to expel waste heat, a first pair of fans 52 and 54 are installed adjacent condenser 32 to comprise a first chiller module 56, and a second pair of fans 58 and 60 are installed adjacent condenser 44 to comprise a second chiller module 62. More specifically, fans 52 and 54 are closer to condenser 32 than condenser 44, and fans 58 and 60 are closer to condenser 44 than condenser 32. When operating, fans 52, 54, 58 and 60 can force outside air across the condensers to draw heat from the compressed refrigerant inside the condensers.

Based on the cooling demand, a controller 64 determines which refrigerant circuit 12 and/or 14 is active(i.e., which compressor 30 and/or 42 is operating), and which fans 52, 54, 58 and/or 60 are energized. Controller 64 is schematically illustrated to represent a wide variety of controllers known to those skilled in the art. Examples of controller 64 include, but are not limited to, personal computers, microcomputers, thermostats, dedicated electrical circuits having analog and/or digital components, programmable logic controllers, and various combinations thereof. Controller 64 can determine the cooling load based on various methods or algorithms known to those skilled in the art. For example, a temperature sensor 66 can provide a feedback signal 68 that indicates the temperature of the chilled water 16. Controller 64 can then control the various components of chiller system 10 upon comparing feedback signal 68 to a predetermined temperature target.

During periods of high cooling demand, controller 64 may activate both circuits 12 and 14 by energizing both compressors 30 and 42. The commands to energize compressors 30 and 42 are represented by output signals 70 and 72, respectively. During this time, controller 64 may also energize all four condenser fans via output signals 74, 76, 78 and 80.

During periods of moderate cooling demand, controller 64 may allow just circuit 12 to operate and deactivate circuit 14 by de-energizing compressor 42 (thereby inhibiting refrigerant from flowing through circuit 14). Signals 78 and 80 may de-energize fans 58 and 60, and controller 64 may leave fans 52 and 54 operating to serve the needs of refrigerant circuit 12. If the cooling demand diminishes, controller 64 may de-energize fan 52, and leave just fan 54 operating.

Under certain conditions, the cooling demand may become so low that even fan 54 operating alone may be too much for chiller system 10. This may occur during low ambient temperature conditions where the temperature of the outside air (the air that cools the condensers) is quite low, for example, less than 25 degrees Fahrenheit. When this occurs, controller 64 shifts the operation of chiller system 10 from a normal mode (e.g., operation during periods of moderate or high cooling demands) to a low ambient temperature mode.

Figure 2:
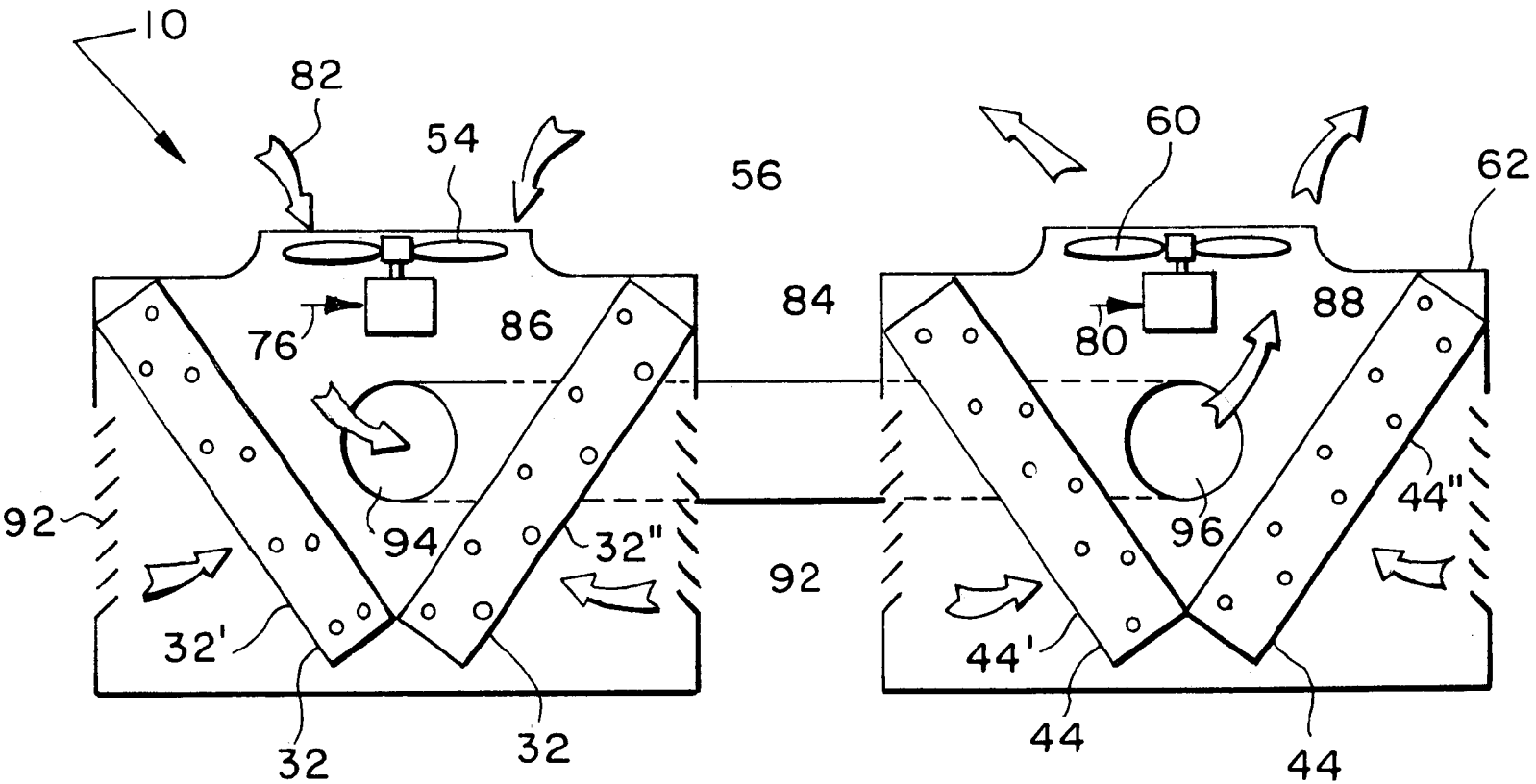
FIG. 2 is a cross-sectional view taken along line 2—2 of FIG. 1.

In the low ambient temperature mode, controller 64 energizes compressor 30, de-energizes compressor 42; de-energizes fans 52 and 54; and energizes fan 60 (and/or fan 58), as shown in FIG. 2. To enable fan 60 to draw ambient air 82 across condenser 32, an air duct 84 connects a first condenser plenum 86 of first chiller module 56 to a second condenser plenum 88 of second chiller module 62. Condenser plenums 86 and 88 are defined by their respective condensers 32 and 44 in that the condensers border the plenums. This is true regardless of whether the condenser is V-shaped, flat, or some other shape. It should be noted that various air block-off plates 90 might be needed at various locations to ensure that air drawn into a chiller module is forced to pass through its condenser, rather than bypass the condenser.

In some embodiments of the invention, condenser 32 comprises two condenser circuits 32' and 32" mounted in a V-shape. Likewise, condenser 44 may also be V-shaped with two condenser circuits 44' and 44". A similar condenser arrangement is disclosed in U.S. Pat. No. 5,067,560, which is specifically incorporated by reference herein. With a condenser having two condenser circuits, the refrigerant preferably flows in parallel through the two condenser circuits. However, two condenser circuits connected in series-flow relationship with each other is also well within the scope of the invention.

With air duct 84 connecting condenser plenums 86 and 88, fan 60 can draw ambient air 82 into chiller module 56, as indicated by the airflow arrows of FIG. 2. Some air enters condenser plenum 86 by being drawn in directly past de-energized fans 52 and 54. Some additional air enters by passing through louvers 92 and condenser 32. It is this current of air passing through active condenser 32 that condenses refrigerant inside condenser 32 during the low ambient temperature mode. From condenser plenum 86, the now warmer air exits chiller module 56 through an opening 94, travels through duct 84, and enters condenser plenum 88 of module 62 through an opening 96. From condenser plenum 88, fan 60 exhausts the air out of chiller module 62.

In the low ambient temperature mode, fan 60 preferably forces less air across active condenser 32 than across inactive condenser 44. Also, the cross-sectional area of duct 84 is preferably significantly smaller than the inlet area of plenums 86 (i.e., the plenum area that the air crosses upon entering the plenum), such that duct 84 provides appreciable airflow resistance. In that regard, the air velocity through duct 84 is greater than the average velocity through plenum 86 or through condenser 32.

In sum, fan 60 forces more air across inactive condenser 44 than across active condenser 32 in the low ambient temperature mode. At certain periods of moderate cooling demand, fan 52 and/or fan 54 draws air across condenser 32, while refrigerant circuit 12 is inactive and fans 58 and 60 are de-energized. Alternatively, fan 58 and/or fan 60 draws air across condenser 44, while refrigerant circuit 12 is inactive and fans 52 and 54 are de-energized. At certain periods of higher cooling demand, both compressors 30 and 42 may operate, and fans 52, 54, 58, and 60 may be selectively energized as needed. To meet a maximum cooling demand, compressors 30 and 42 and fans 52, 54, 58 and 60 are all energized. In some cases, if the fans in chiller module 56 were to move the same volume of air as the fans of chiller module 62, the airflow through duct 84 may be negligible.

Although the invention is described with reference to a preferred embodiment, it should be appreciated by those skilled in the art that other variations are well within the scope of the invention. For example, chiller system 10 may include more than two refrigerant circuits, the chiller modules or refrigerant circuits may be in various configurations other than side-by-side or end-to-end, condensers 32 and 44 may each have more or less than two condenser circuits, and condensers 32 and 44 may each have more or less than two condenser fans. Therefore, the scope of the invention is to be determined by reference to the claims, which follow.

I claim:

1. A method of operating a chiller system, comprising:

forcing a first charge of refrigerant to flow in series through a first compressor and a first condenser;

inhibiting a second charge of refrigerant from flowing in series through a second compressor and a second condenser; and forcing more air across the second condenser than across the first condenser.

2. The method of claim 1, wherein the step of inhibiting the second charge of refrigerant from flowing in series through the second compressor and the second condenser is carried out by de-energizing the second compressor.

3. The method of claim 1, further comprising isolating the first charge of refrigerant from the second charge of refrigerant.

4. The method of claim 1, further comprising conveying air from the first condenser, through an air duct, to the second condenser, wherein the air travels at a higher velocity through the air duct than across the first condenser.

5. A chiller system comprising:

a first refrigerant circuit that includes an energized compressor and a first condenser;

a second refrigerant circuit that includes a de-energized compressor and a second condenser;

a de-energized fan adjacent the first condenser such that the de-energized fan is closer to the first condenser than the second condenser; and an energized fan adjacent the second condenser such that the energized fan is closer to the second condenser than the first condenser.

6. The chiller system of claim 5, wherein the energized fan forces more air across the second condenser than across the first condenser.

7. The chiller system of claim 5, wherein the energized fan forces air across the de-energized fan.

8. The chiller system of claim 5, further comprising a first refrigerant charge in the first refrigerant circuit and a second refrigerant charge in the second refrigerant circuit, wherein the first refrigerant charge is separate from the second refrigerant charge.

9. The chiller system of claim 5, further comprising an air duct that places the first condenser in fluid communication with the second condenser, wherein the energized fan forces air through the air duct at a higher velocity than a velocity at which air passes across the first condenser when the energized fan is energized and the de-energized fan is de-energized.

10. A chiller system selectively operable in a low ambient temperature mode, the chiller comprising:

a first refrigerant circuit that includes a first compressor and a first condenser;

a second refrigerant circuit that includes a second compressor and a second condenser;

a first fan adjacent the first condenser such that the first fan is closer to the first condenser than the second condenser;

a second fan adjacent the second condenser such that the second fan is closer to the second condenser than the first condenser;

an air duct that places the first condenser in air communication with the second condenser; and a control operatively connected to the first compressor, the second compressor, the first fan and the second fan, wherein the control energizes the first compressor, energizes the second fan, de-energizes the second compressor, and de-energizes the first fan to allow the second fan to draw air in series across the first condenser, through the air duct, and across the second condenser, thereby placing the chiller system in the low ambient temperature mode of operation.

11. The chiller system of claim 10, wherein the second fan forces more air across the second condenser than across the first condenser when the chiller system is in the low ambient temperature mode of operation.

12. The chiller system of claim 10, wherein the second fan forces air across the first fan when the chiller system is in the low ambient temperature mode of operation.

13. The chiller system of claim 10, further comprising a first refrigerant charge in the first refrigerant circuit and a second refrigerant charge in the second refrigerant circuit, wherein the first refrigerant charge is separate from the second refrigerant charge.

14. The chiller system of claim 10, wherein the second fan forces air through the air duct at a higher velocity than a velocity at which air passes across the first condenser when the chiller system is in the low ambient temperature mode of operation.

15. The chiller system of claim 10, wherein the control energizes the first compressor, energizes the second compressor, energizes the first fan and energizes the second fan to selectively place the chiller system in a normal mode of operation.

16. A chiller system, comprising:

a first chiller module comprising a first refrigerant circuit and a first pair of condenser fans, wherein the first refrigerant circuit includes, in series flow relationship with each other, a first compressor, a first condenser, a first expansion device, and a first evaporator, wherein the first condenser defines a first condenser plenum, the first pair of condenser fans are adjacent the first condenser, and the first refrigerant circuit contains a first charge of refrigerant;

a second chiller module comprising a second refrigerant circuit and a second pair of condenser fans, wherein the second refrigerant circuit includes, in series flow relationship with each other, a second compressor, a second condenser, a second expansion device, and a second evaporator, wherein the second condenser defines a second condenser plenum, the second pair of condenser fans are adjacent the second condenser, and the second refrigerant circuit contains a second charge of refrigerant separate from the first charge of refrigerant;

an air duct connecting the first condenser plenum in fluid communication with the second condenser plenum; and a control operatively connected to the first compressor, the first pair of condenser fans, the second compressor, and the second pair of condenser fans, wherein the control energizes the first compressor, energizes one fan of the second pair of condenser fans, de-energizes another fan of the second pair of condenser fans, and de-energizes the first pair of condenser fans, thereby placing the chiller system in a low ambient temperature mode of operation wherein the one fan draws air in series across the first condenser, through the first condenser plenum, through the air duct, through the second condenser plenum, and across the second condenser.

17. The chiller system of claim 16, wherein the control energizes the first compressor, energizes the second compressor, energizes the first pair of condenser fans, and energizes the second pair of condenser fans to selectively place the chiller system in a normal mode of operation.

18. The chiller system of claim 16, wherein the one fan forces more air across the second condenser than across the first condenser when the chiller system is in the low ambient temperature mode of operation.

19. The chiller system of claim 16, wherein the one fan forces air across the first pair of condenser fan when the chiller system is in the low ambient temperature mode of operation.

20. The chiller system of claim 16, wherein the one fan forces air through the air duct at a higher velocity than a velocity at which air passes across the first condenser when the chiller system is in the low ambient temperature mode of operation.

21. A chiller system, comprising:

a first compressor;

a first condenser in operable association with the first compressor;

a second compressor;

a second condenser in operable association with the second compressor;

means for forcing a first charge of refrigerant to flow in series through the first compressor and the first condenser;

means for inhibiting a second charge of refrigerant from flowing in series through the second compressor and the second condenser; and means for forcing more air across the second condenser than across the first condenser.

22. The system of claim 21, wherein the means for inhibiting the second charge of refrigerant from flowing in series through the second compressor and the second condenser further includes means for de-energizing the second compressor.

23. The system of claim 21, further comprising means for isolating the first charge of refrigerant from the second charge of refrigerant.

24. The system of claim 21, further comprising means for conveying air from the first condenser, through an air duct, to the second condenser, wherein the air travels at a higher velocity through the air duct than across the first condenser.

* * * * *